US007637189B2

(12) United States Patent
Schlüsselbauer

(10) Patent No.: US 7,637,189 B2
(45) Date of Patent: Dec. 29, 2009

(54) APPARATUS FOR FACE-SIDE MACHINING OF A PROFILE ELEMENT FORMING A NEGATIVE MOLD FOR THE BRANCH OF A CHANNEL IN A SHAFT FLOOR

(76) Inventor: Johann Schlüsselbauer, Obergmain 2, A-4674 Altenhof am Hausruck (AT)

( * ) Notice: Subject to any disclaimer, the term of this patent is extended or adjusted under 35 U.S.C. 154(b) by 211 days.

(21) Appl. No.: 11/054,181

(22) Filed: Feb. 9, 2005

(65) Prior Publication Data

US 2005/0233022 A1 Oct. 20, 2005

(30) Foreign Application Priority Data

Mar. 24, 2004 (AT) ..... A 518/2004

(51) Int. Cl.
*B26F 3/12* (2006.01)

(52) U.S. Cl. ..... 83/171; 83/651.1

(58) Field of Classification Search ..... 83/171, 83/16, 307.1–307.3, 651.1, 307; 425/193
See application file for complete search history.

(56) References Cited

U.S. PATENT DOCUMENTS 2,464,178 A * 3/1949 Green et al. ..... 292/306
2,749,608 A * 6/1956 Siemer ..... 29/463
3,018,355 A * 1/1962 Wallerstein ..... 83/171
3,117,211 A * 1/1964 Tansey ..... 83/171
4,077,301 A * 3/1978 Brahm ..... 409/124
5,191,824 A * 3/1993 Rathbun, Jr. ..... 83/874
5,533,430 A * 7/1996 Buch ..... 83/171

FOREIGN PATENT DOCUMENTS

FR 2 599 661 12/1997

* cited by examiner

*Primary Examiner*—Stephen Choi
(74) *Attorney, Agent, or Firm*—Collard & Roe, P.C.

(57) ABSTRACT

An apparatus is described for machining on the face side a negative mold for a profile element (1) which is made of thermoplastic foamed material, forms the branch of a channel of a shaft floor and can be applied in an interlocking manner to a profile strand for the main channel, comprising a table (3) for receiving the profile element (1) to be machined and with a support (5) which is movable along a predetermined planar path for a curved heating wire (4) extending in one plane along the profile. In order to provide simple machining conditions it is proposed that the support (5) can be moved along a path corresponding to the axial progress of the profile strand for the main channel, that the heating wire (4) has a progress which corresponds to the contour of the profile strand for the main channel and that the support (5) which is held in a rotatable manner about an axis perpendicular to the plane of the path can be rotated within the terms of a permanent perpendicular orientation of the heating wire plane relative to the path of the support (5).

5 Claims, 8 Drawing Sheets

APPARATUS FOR FACE-SIDE MACHINING OF A PROFILE ELEMENT FORMING A NEGATIVE MOLD FOR THE BRANCH OF A CHANNEL IN A SHAFT FLOOR

FIELD OF THE INVENTION

The invention relates to an apparatus for machining on the face side a negative mold for a profile element which is made of thermoplastic foamed material, forms the branch of a channel of a shaft floor and can be applied in an interlocking manner to a profile strand for the main channel, comprising a table for receiving the profile element to be machined and with a support which is movable along a predetermined planar path for a curved heating wire extending in one plane along the profile.

DESRIPTION OF THE PRIOR ART

Due to the necessary adaptation of the channels to the local conditions of a construction site, shaft floors are generally made with a rough floor without a channel in a mold consisting of a pot-like core and a jacket and the channel is thereafter formed by hand according to the respective waste water guidance. In order to achieve a mechanical production of the lower parts of the shaft despite a comparatively simple adaptation to the local conditions at the construction site, the channel branches which open into the main channel and usually extend in a straight manner can be produced at least with the help of the profile elements which are fastened as a female mold of the channel branch on the floor of the mold core and be adjacent to the profile strand for the main channel formed by the mold core. Especially simple constructional conditions are obtained when the profile strand for the main channel is composed of straight and arc-shaped sections and is also fastened to the floor of the mold core because in this case the profile strand for the main channel can also be adapted to the local conditions at the construction site. It needs to be ensured however that the connecting surfaces on the profile elements on the face side are machined according to the profile cross section and the axial progress of the profile strand for the main channel, which cannot be performed without problems due to the required different curvatures of these connecting surfaces. Although heating wires with a curved progress are known for cutting profiles of thermoplastic subjects, such known apparatuses for the thermal cutting of thermoplastic foamed materials are unsuitable for machining curved spatial surfaces as are required for the connecting surfaces of the profile elements for the channel branches.

SUMMARY OF THE INVENTION

The invention is therefore based on the object of providing an apparatus for the simple machining of a profile element forming a negative mold for a branch of a shaft floor channel according to the cross-sectional shape and the axial progress of the profile strand of the main channel.

Based on an apparatus of the kind mentioned above, the invention achieves this object in such a way that the support can be moved along a path corresponding to the axial progress of the profile strand for the main channel, that the heating wire has a progress which corresponds to the contour of the profile strand for the main channel and that the support which is held in a rotatable manner about an axis perpendicular to the plane of the path can be rotated within the terms of a permanent perpendicular orientation of the heating wire plane relative to the path of the support.

To ensure that the connecting surfaces of the profile elements for the channel branches of the contour surface of the profile strand for the main channel, which channel branches open into the main channel, it is merely necessary to move a heating wire which is shaped according to the contour progress of a profile cross section of the profile strand along a path corresponding to the axial progress of the profile strand relative to the aligned profile element, if it is ensured that the plane of the heating wire is always oriented perpendicularly to the axial progress of the profile strand for the main channel. In this case the heating wire passes over an enveloping surface which corresponds to the surface of the profile strand in the connecting region of the channel branch, so that this profile element can be positioned in an interlocking manner on the profile strand for the main channel following the face-side cutting of a profile element.

To ensure that the heating wire can be moved along a path corresponding to the axial progress of the profile strand for the main channel, the support can be rotatably held in a cross slide and can be connected with a rotational drive triggered by a control device depending on the movement of the cross slide. The cross slide can be used to move the support for the heating wire with computer support along a predetermined, principally random path. The alignment of the heating wire plane relative to the path of movement occurs via the rotational drive, namely according to a predetermined computer program. To ensure that for the calculation of the path of the support of the heating wire it is not necessary to detect the respective position of the profile element to be machined, the position of the profile element on the receiving table can be predetermined in a constructional respect relative to a receiving axis.

Since the profile strand for the main channel can always be composed of straight and arc-shaped sections, a guidance is sufficient for the heating wire which consists of an arc guidance for a linear guidance which is aligned tangentially thereto. In the region of the arc section of the profile strand, the heating wire moved with the linear guidance along the arc guidance covers a toroid surface with the profile of the profile strand as the generatrix. In the transitional region from the arc section to the straight section of the profile strand, the linear guidance is stopped in its rotational movement about the axis of the arc guidance and the heating wire is moved along the linear guidance, i.e. tangentially to the arc guidance. Under the given conditions, all possible connecting surfaces of a profile element for a channel branch opening into a main channel can be produced with the help of a heating wire formed according to the contour progress of the main channel if the profile element to be machined is aligned accordingly relative to the heating wire and its guide means.

For this purpose, the table can be held in a pivotably adjustable way about an axis parallel to the axis of the arc guidance, so that the shaped part clamped on the table ready for machining can be swiveled with the table to the respective angular position relative to the main channel. If one assumes that the straight sections of the main channel which are mutually joined through an arc-shaped section and the channel branch adjacent to the main channel extend in a radial manner relative to the channel floor (meaning that the axes of the straight sections of the main channel and the channel branch intersect in the axis of the shaft floor), the distance between the axis of the shaft floor and the axis of the arc-shaped section of the main channel changes with the length of the arc-shaped section. This means that the distance between the axis of the arc guidance and the swiveling axis of the table must be set accordingly. This setting can advantageously be made in such a way that the pivoting bearing of the table is adjustably held on a sliding guide means which extends in the direction of a predetermined axial progress for a straight section of the profile strand of the main channel. In this way, the table can be displaced relative to the axis of the arc guidance along the predetermined axial progress for a straight section of the main channel to the respective point of intersection of the straight channel sections in order to be swiveled according to the angular course of the channel branch to be connected relative to the predetermined axial progress of the main channel. The alignment of the profile element to be machined relative to the arc guidance for the heating wire is thus completed. The necessary settings on the basis of the constructional requirements of the shaft floor channel from a drawing for example can be made with ease through a respective measuring scale on the sliding guide means for the pivoting bearing of the table and the pivoting bearing per se.

Although the arc guidance for the linear guidance can be configured in different ways, especially simple constructional conditions are obtained when the arc guidance consists of a pivoting arm which supports the linear guidance for the support of the heating wire.

Since the cross-sectional shape and size of the main channel can differ depending on the contiguous piping, heating wires must be inserted which are shaped according to the individual cross-sectional shapes and sizes of the main channel. In order to reduce the amount of work for changing the heating wires, the support with the heating wire can be exchangeable with a support with heating wires of different contours held in a hopper.

BRIEF DESCRIPTION OF THE DRAWINGS

The subject matter of the invention is shown by way of examples in the drawings, wherein.

DESCRIPTION OF THE PREFERRED EMBODIMENT

Figure 1:
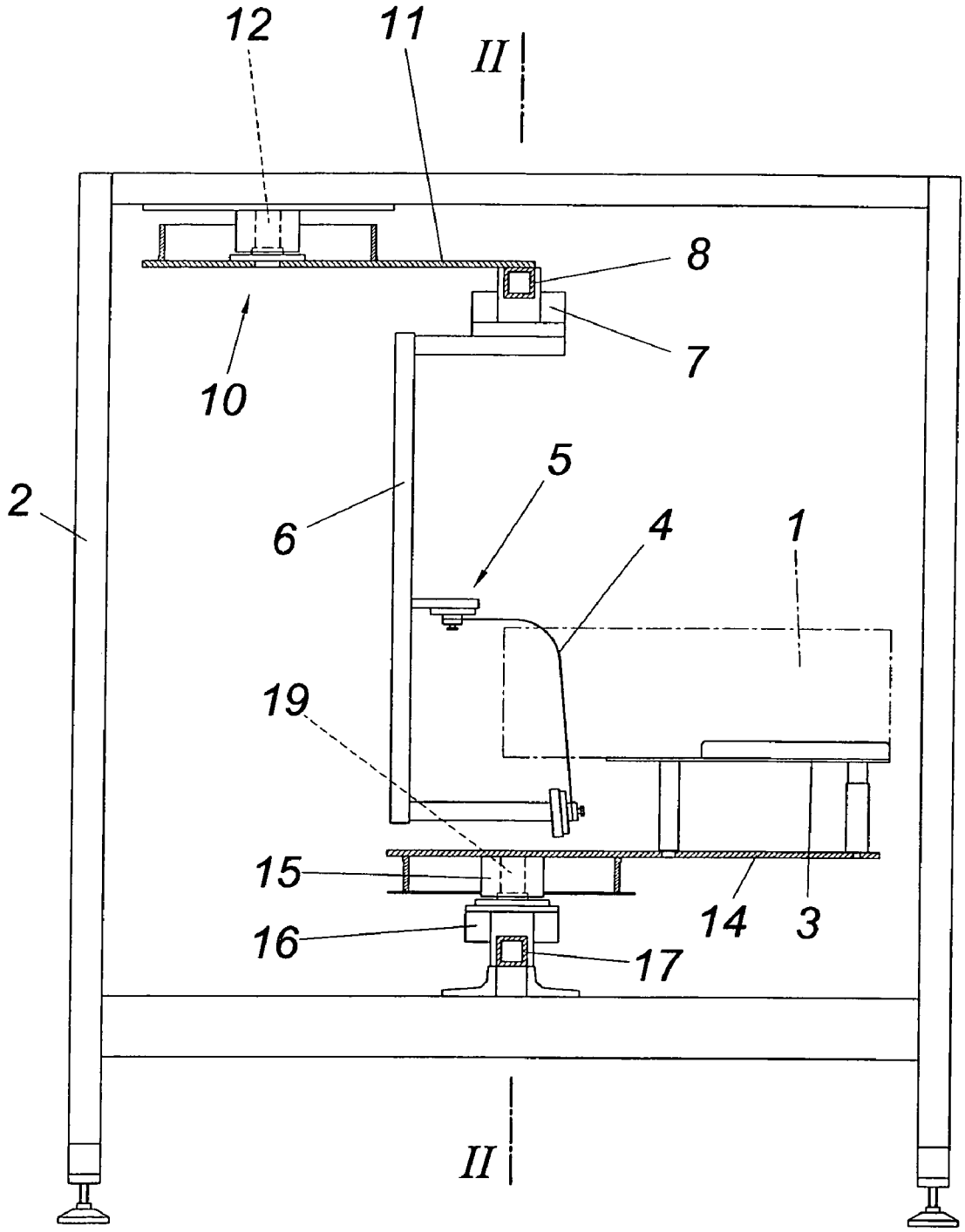
FIG. 1 shows an apparatus in accordance with the invention for face-side machining of a profile element forming a negative mold for the branch of a channel in a shaft floor in a partly elevated side view.
Figure 2:
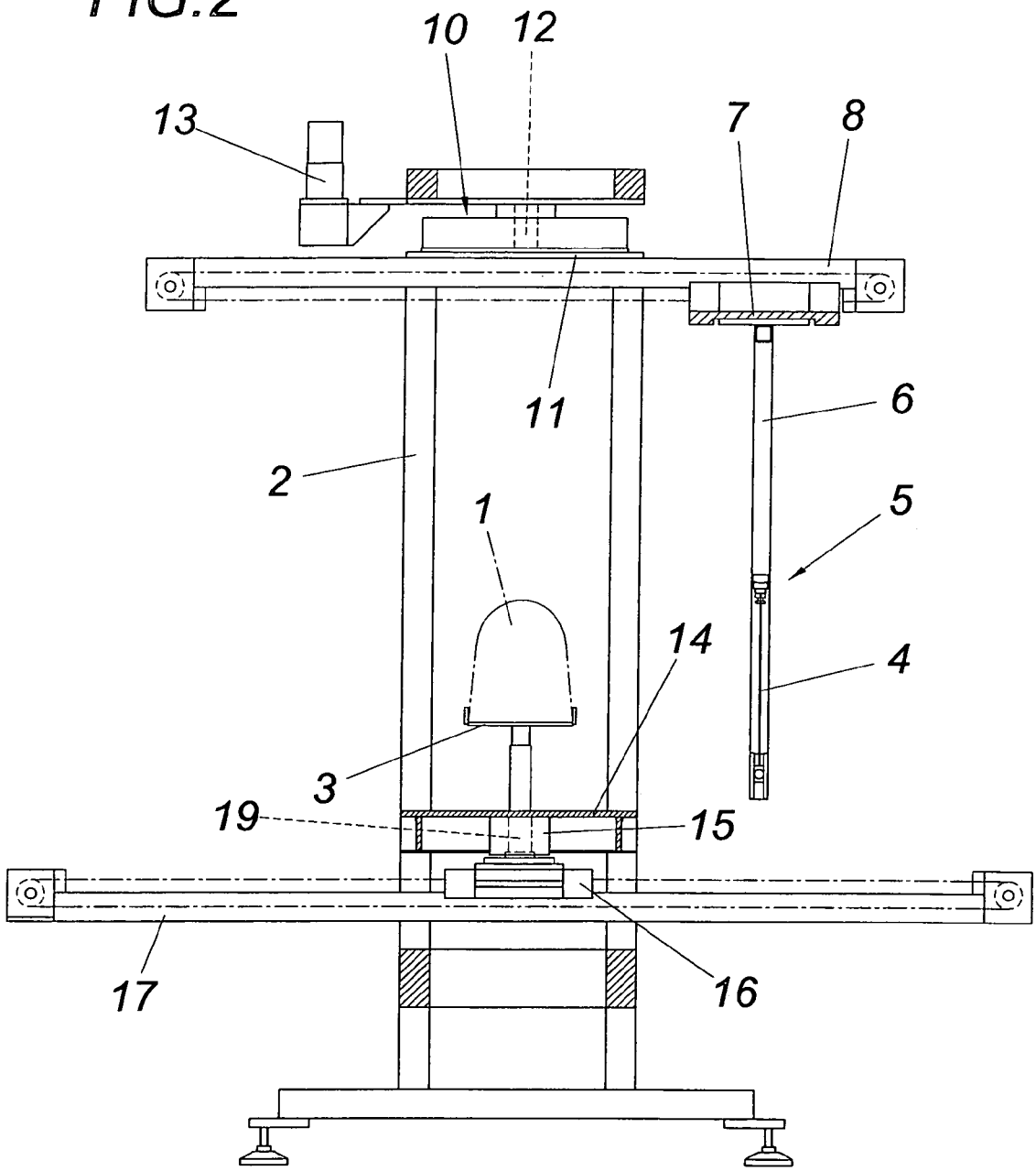
FIG. 2 shows this apparatus in a schematic vertical sectional view along line II-II of FIG. 1.
Figure 3:
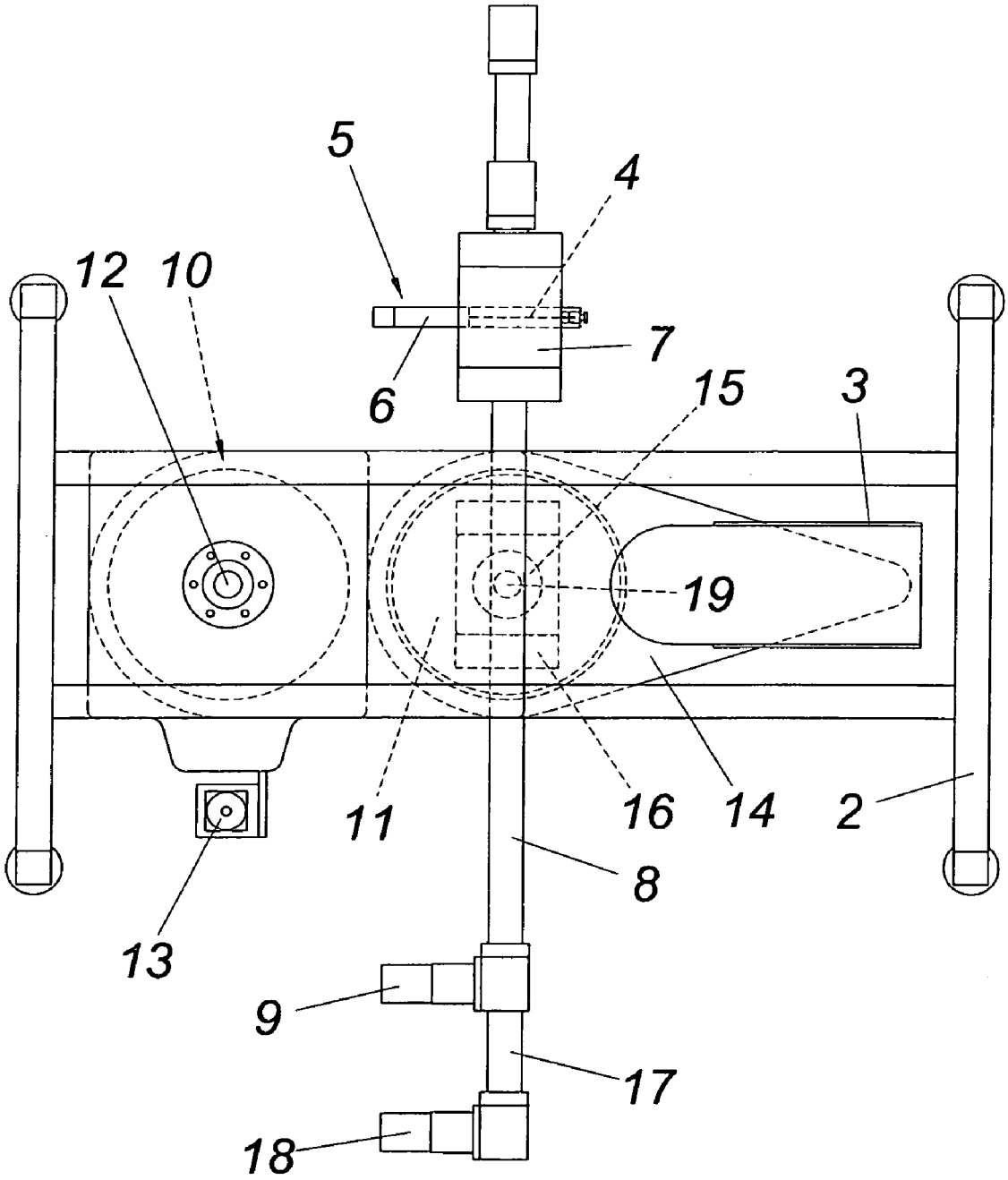
FIG. 3 shows a top view of the apparatus.

The apparatus as shown in FIGS. 1 to 5 for the face-side machining of a profile element 1 forming a negative mold for the branch of a channel in a shaft floor comprises a frame 2 which supports a table 3 for receiving the profile element 1 and a heating wire 4 which is shaped according to the contour of the cross section of the main channel and is used for cutting the profile element 1 made of thermoplastic foamed material. Said heating wire 4 is clamped in a support 5 which is configured as a bracket 6 and can be displaced by means of a slide 7 along a linear guidance 8. A motor 9 is used for driving the slide 7. The linear guidance 8 is arranged on a pivoting arm 11 forming an arc guidance 10 and extends tangentially to said arc guidance 10 whose axis is designated with 12. A motor 13 is used as a rotational drive for the pivoting arm 11. The heating wire 4 can therefore be rotated on the one hand about the axis 12 of the arc guidance 10 and displaced on the other hand along the linear guidance 8.

The table 3 is provided on a pivoting arm 14 which is held with the help of a pivoting bearing 15 on a slide 16 of a sliding guidance 17. The table 3 can thus be displaced with the help of the slide 16 via motor 18 along the sliding guidance 17. Moreover, the table 3 can be set relative to its angular position, namely by a rotational adjustment about the axis 19 of the pivoting bearing 15.

Figure 4:
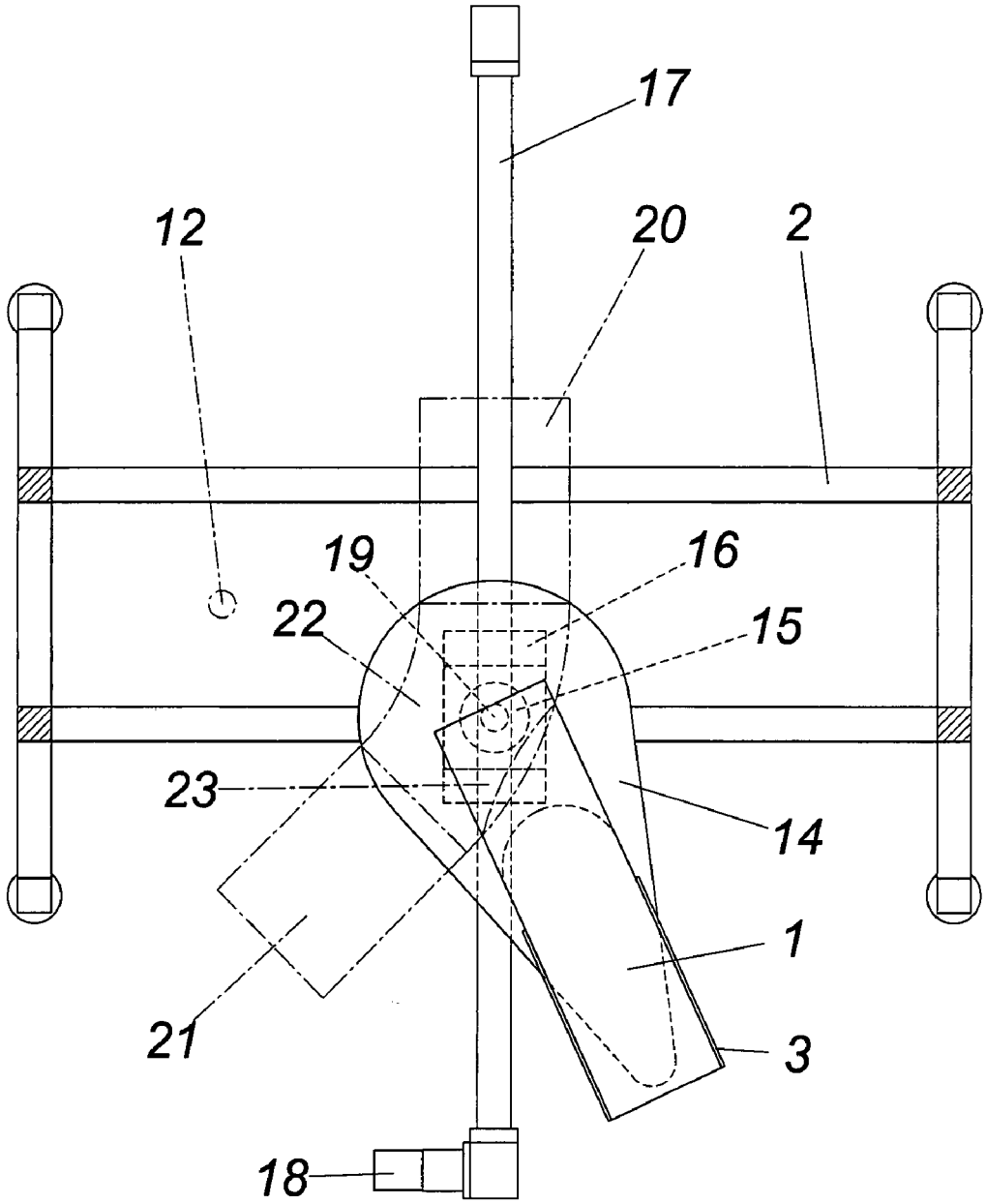
FIG. 4 shows a top view of the table aligned relative to the axis of the arc guidance for receiving a profile element for a predetermined shaft floor channel in a manner so as to be ready for machining.
Figure 5:
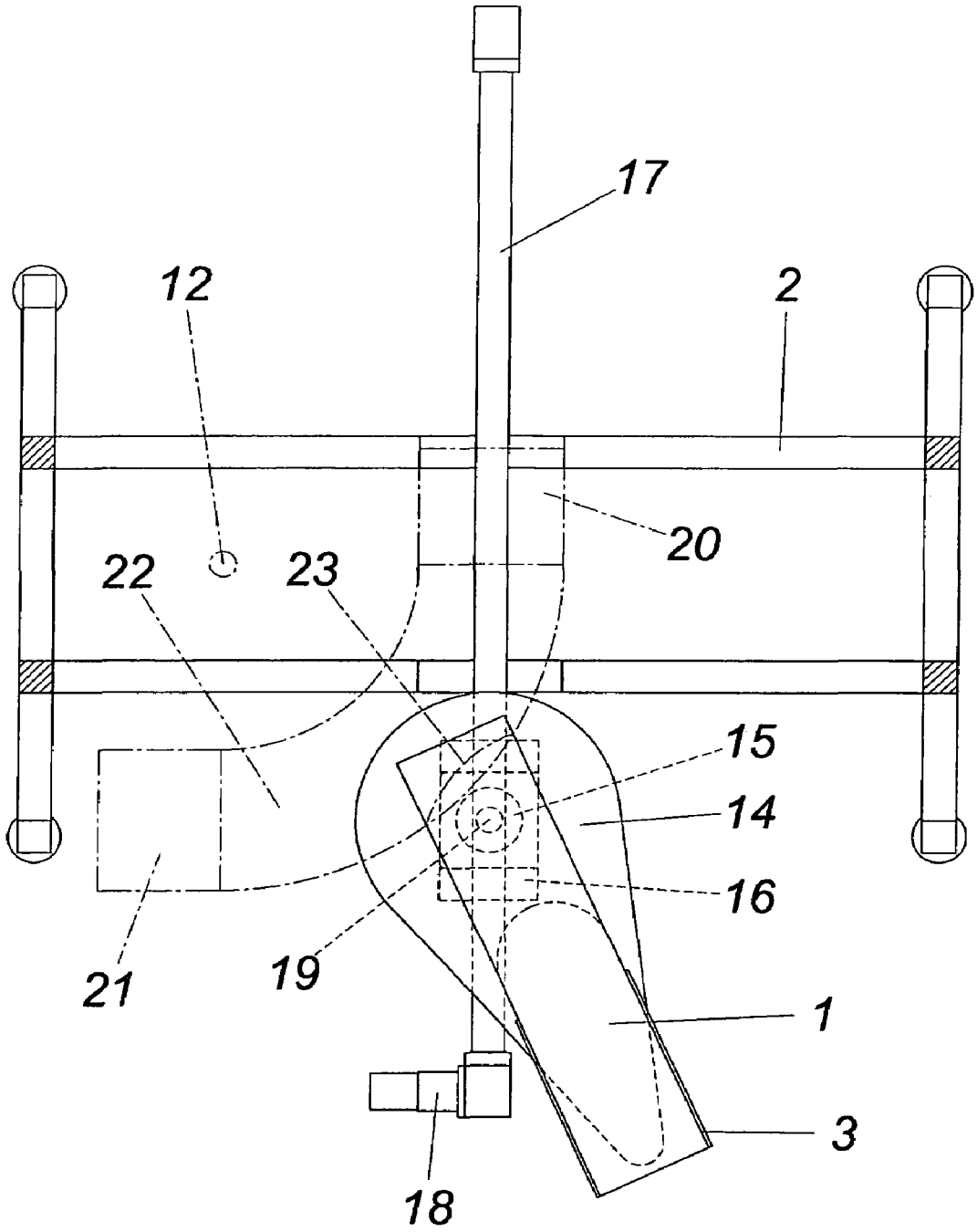
FIG. 5 shows a representation corresponding to FIG. 4, but for a different embodiment of the shaft floor channel.
Figure 6:
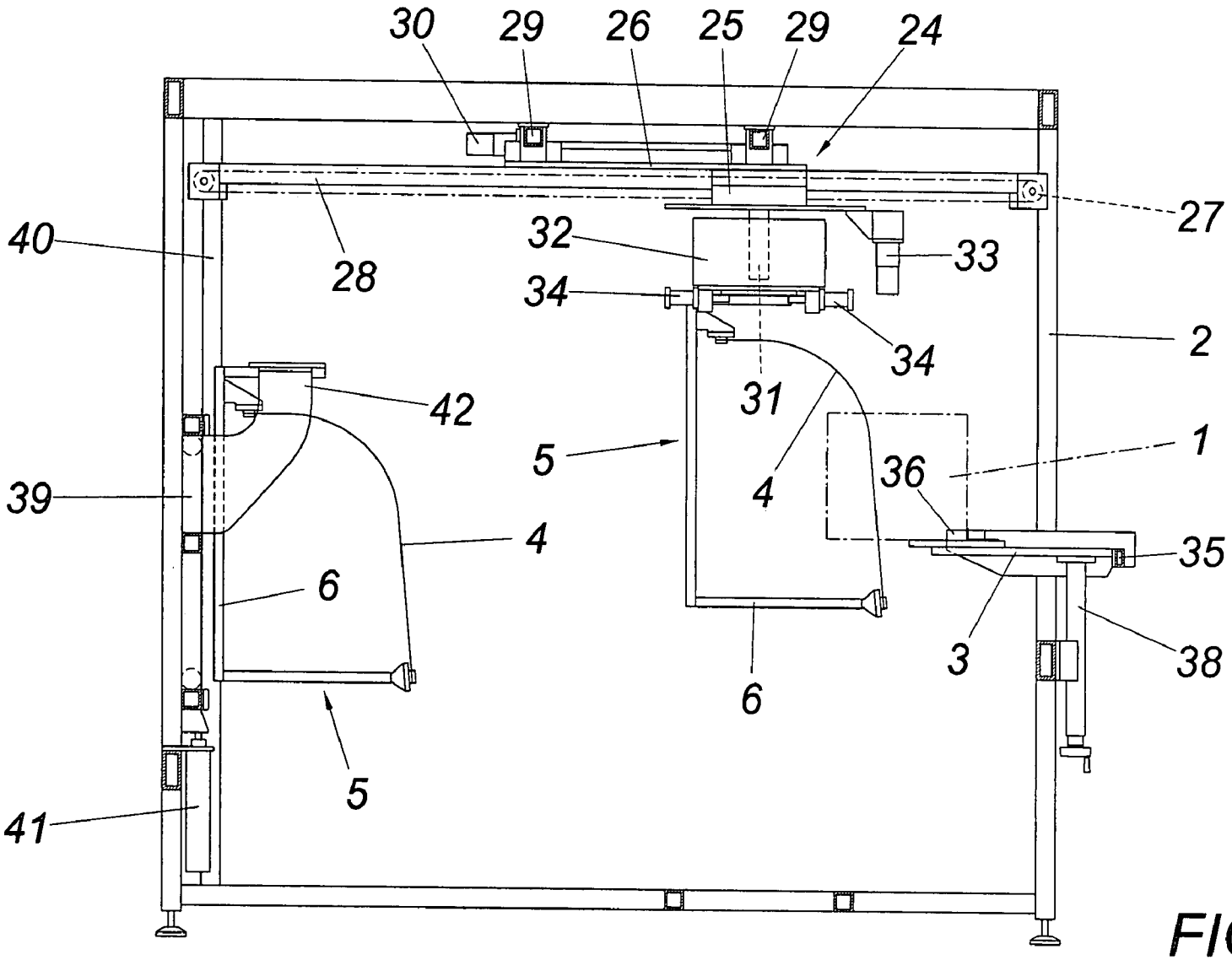
FIG. 6 shows a constructional variant of an apparatus in accordance with the invention in a schematic longitudinal sectional view.
Figure 7:
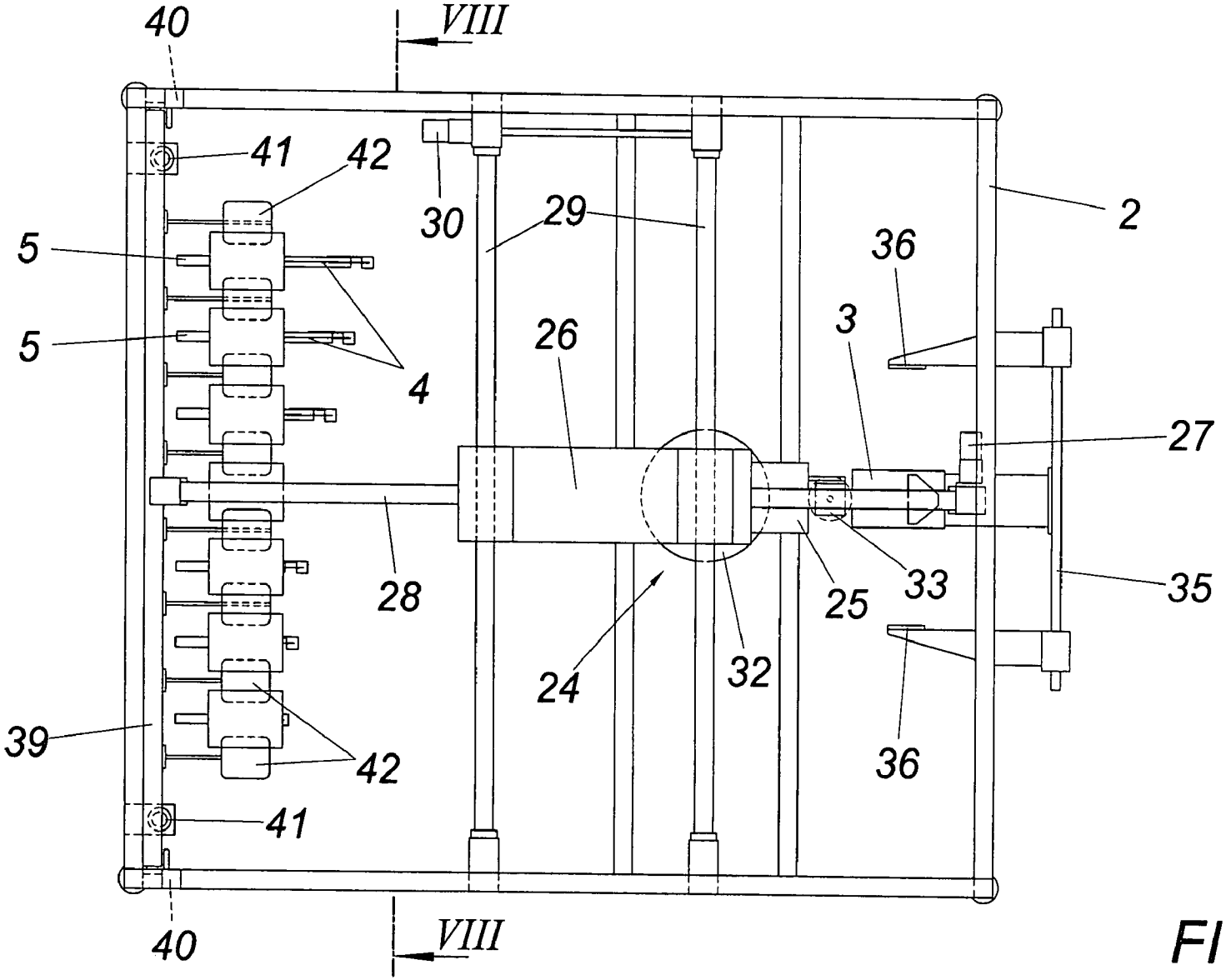
FIG. 7 shows the apparatus according to FIG. 6 in a top view.

In order to machine the face side of a profile element 1 which forms a negative mold for a channel branch of a shaft floor channel with a predetermined progress of the main channel, the profile element 1 must be fixed with the help of the table 3 in a respectively aligned manner in the frame 2, as is shown in FIGS. 4 and 5 according to two different progresses of the main channel. The profile strand provided for shaping the main channel is composed of two straight sections 20, 21 and an arc-shaped section 22 which joins these two straight sections 20, 21, with said sections having a cross-sectional shape whose contour is emulated by the heating wire 4, as is shown in FIG. 1. Since the smallest permissible radius for the arc-shaped section 22 is predetermined by the largest cross section of the main channel, one can assume a uniform radius of the arc-shaped sections 22 irrespective of the cross-sectional size of the main channel, which represents a precondition for an unchanging radius of the arc guidance 10. It is merely necessary to adjust the heating wire 4 to the respective cross-sectional shape of the main groove.

A further precondition for the apparatus according to FIGS. 1 to 5 is the demand that the axes of the straight sections 20 and 21 of the profile strand and the profile element 1 to be machined extend radially to the axis of the shaft floor and therefore intersect in an axis which coincides with the axis 19 of the pivoting bearing 15 for the table 3. If the sliding guidance 17 for the table 3 extends additionally in the axis of the one straight section 20 of the profile strand, the profile element 1 can simply be aligned relative to the heating wire 4 via the table adjustment that the profile element 1 is cut along a connecting surface 23 snuggling up to the profile strand.

As can be seen from FIGS. 4 and 5, the distance of the axis 12 of the arc guidance 10 from the axis 19 of the pivoting bearing 15 for the table 3 depends on the mutual angular position of the straight sections 20 and 21 of the profile strand at a predetermined radius of curvature of the straight sections 20 and 21 of the profile strand. At a mutual angular position of 135° of the straight sections 20 and 21, this axial distances is smaller than in the case of a mutual angular position of 90°, as is indicated in FIG. 5. This means that the table 3 needs to be displaced via the slide 16 depending on the mutual angular position of the straight sections 20 and 21 along the sliding guidance 17 by an amount predetermined by the progress of the main channel in order to enable the cutting of the profile element 1 on the face side with the help of the heating wire 4 according to the surface progress of the profile strand in the case of a respective angular orientation of the table 1 relative to sliding guidance 17 which predetermines the axial progress of the straight section 20. It is understood that the corporeal provision of the profile strand is not necessary. It is merely necessary to accordingly align the profile element 1 relative to the guidance of the heating wire 4.

Whereas the connecting surface 23 of the profile element 1 on the face side come to lie completely in the region of the arc-shaped section 22 of the profile strand in the course of the main channel as shown in FIG. 5, this connecting surface 23 projects into the straight section 21 in a progress of the main channel according to FIG. 4. This means that at first the heating wire 4 is turned in a position of the slide 7 in the contact point between the tangent formed by the linear guidance 8 and the arc formed by the arc guidance 10 about the axis 12 of the arc guidance 10 until the heating wire 4 reaches the abutment surface between the arc-shaped section 22 and the straight section 21 of the profile strand. Upon reaching this rotational position, the motor 13 for the arc guidance 10 needs to be cut off and the drive 9 for the slide 7 needs to be activated in order to cut the remaining section of the connecting surface 23 according to the surface progress of the straight section 21. The cross-sectional shape of the profile element 1 does not play any role.

In contrast to the embodiment according to FIGS. 1 to 5, the support 5 is received by a cross slide 24 which is formed by a longitudinal slide 25 and a transverse slide 26. The longitudinal slide 25 can be displaced with the help of drive 27 along a longitudinal rail 28 which is held in the transverse slide 26. A guidance 29 in the form of two transverse rails is provided for the transverse slide 26. A drive 30 is used for driving the transverse slide. A head 32 is held in the longitudinal slide 25, which head is rotatable about an axis 31 and is driven with the help of a motor 33. Said head 32 forms an interlocking receiver for the support 5 of the heating wire 4. The support 5 is held in the receiver of the head 32 with the help of the clamping device 34, so that the heating wire of the support 5 follows the rotational movement of the head 32 on the one hand and the movement of the cross slide 24 on the other hand.

The profile element 1 is fixed in an aligned manner on a table 3. For this purpose the table 3 comprises two holding jaws 36 which are adjustable in opposite directions on a guide means 35, which jaws center the profile element 1 on the table 3 relative to a longitudinal center. The profile element 1 is fixed with the help of an adjustable table stop 37 in the axial direction. The height position of the profile element 1 relative to the heating wire 4 can also be set via a lifting drive 38 for the table 3. For the purpose of cutting the profile element 1, the cross slide 24 is triggered by means of a computer program via the drives 27 and 30 in such a way that the cross slide 24 is displaced along a path corresponding to the axial progress of the profile strand for the main channel. In addition, the head 32 needs to be controlled by the motor 33 in such a way that the heating wire 4 which is laid in one plane is always aligned perpendicularly to the trajectory of the cross slide 24, which can also be ensured by the computer program.

Figure 8:
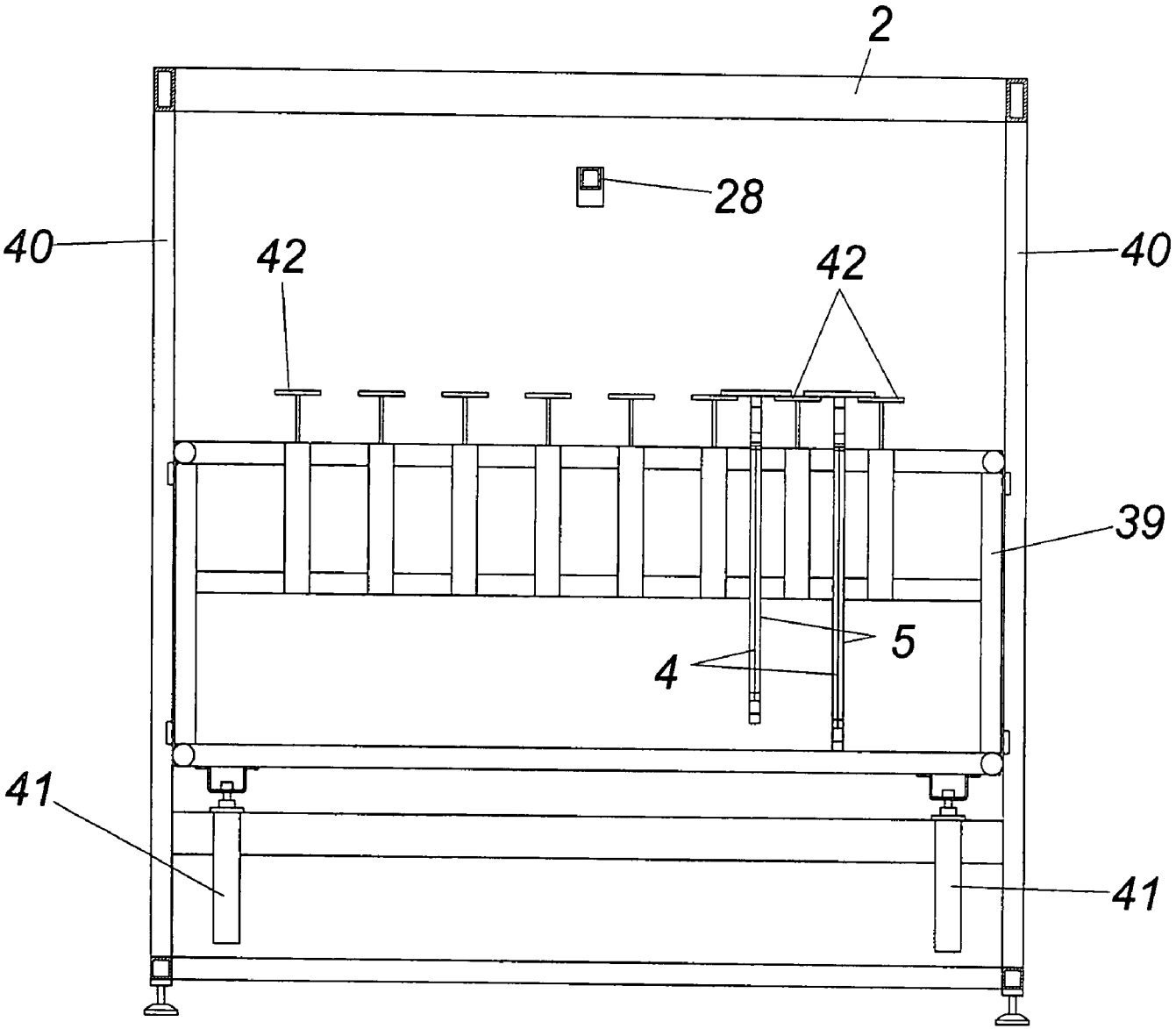
FIG. 8 shows a sectional view along line VIII-VIII of FIG. 7.

In order to enable the adjustment of the profile elements 1 to different cross-sectional shapes and sizes of the main channel, it is necessary to use different heating wires 4 which are adjusted to the respective contours of the profile strand for the main channel. To ensure that the use of different heating wires 4 can be performed in a simple manner, the frame 2 comprises a hopper slide 39 which can be displaced according to height along pillars 40 with the help of lifting cylinders 41. Rests 42 are provided in the lifting slide 39 for supports 5 which are equipped with different heating wires 4, which supports are received between said rests 42, as is indicated in FIG. 8. For changing a heating wire 4, the cross slide 24 is displaced against the hopper slide 39 in such a way that the support 5 clamped in the head 32 engages in an empty space between two supports 42. The support 5 can be received by the head 32 of the cross slide 24 from the hopper slide 39 by pressurizing the lifting cylinder 41 and opening the clamping device 34.

After the displacement of the cross slide 24 to the supports 5 which is placed in the hopper slide 39 and contains the desired heating wire profile, the selected support 5 is lifted in reverse sequence via the hopper slide 39 to the head 32 in order to be latched on head 32 with the help of the clamping device 34 before the hopper slide 39 is lowered to its initial position again.

The invention claimed is:

1. An apparatus for machining a face side of a profile element forming a negative mold for a branch channel interlockingly connectable to a profile strand of a main channel having a main channel axis, the apparatus comprising:

(a) a table for receiving the profile element;

(b) a curved heating wire extending in a first plane and being shaped corresponding to a contour of the profile strand of the main channel;

(c) a support for the heating wire movable along a planar path in a direction of the main channel axis, (1) the support being rotatable about a first axis extending perpendicularly to the planar path of the support and (2) the first plane extending perpendicularly to the planar path; and (d) a guidance for moving and rotating the support, which comprises (1) a linear guide holding the support for displacement along the planar path;

(2) a slide coupled to the linear guide and the support for displacing the support along the linear guide; and (3) an arc guide for the linear guide, the arc guide being pivotal about the first axis and rotating the linear guide along an arc about the first axis, the linear guide extending tangentially to the arc and the arc having a radius corresponding to the radius of an arcuate section of the profile strand.

2. The apparatus according to claim 1, wherein the table is held in a pivoting adjustable way about a pivoting axis parallel to the first axis.

3. The apparatus according to claim 2, wherein the distance between the first axis and the pivoting axis is adjustable.

4. The apparatus according to claim 3, wherein a pivoting bearing of the table is adjustably held on a sliding guide which extends in the direction toward a predetermined axial extension of a straight section of the profile strand.

5. The apparatus according to claim 1, wherein the arc guide comprises a pivoting arm which carries the linear guide for the support of the heating wire.

* * * * *